US006548431B1

(12) United States Patent
Bansal et al.

(10) Patent No.: US 6,548,431 B1
(45) Date of Patent: Apr. 15, 2003

(54) MELT SPUN POLYESTER NONWOVEN SHEET

(75) Inventors: Vishal Bansal, Midlothian, VA (US); Michael C. Davis, Midlothian, VA (US); Edgar N. Rudisill, Nashville, TN (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/467,166

(22) Filed: Dec. 20, 1999

(51) Int. Cl.[7] ..... D04H 1/00

(52) U.S. Cl. ..... 442/327; 442/361; 442/362; 442/363; 442/389; 442/392; 442/400; 264/264; 264/171.1; 264/172.14; 264/172.17

(58) Field of Search ..... 442/327, 361, 442/362, 363, 364, 389, 392, 400; 264/171.1, 172.14, 172.17

(56) References Cited

U.S. PATENT DOCUMENTS

| | | | | |
|---|---|---|---|---|
| 3,802,817 A | | 4/1974 | Matsuki et al. | 425/66 |
| 4,338,275 A | | 7/1982 | Carr | |
| 4,426,516 A | | 1/1984 | Kuriki et al. | |
| 4,701,365 A | | 10/1987 | Iwasaki | |
| 4,743,504 A | | 5/1988 | Carr | 428/364 |
| 4,818,456 A | | 4/1989 | Perez et al. | 264/103 |
| 5,068,141 A | * | 11/1991 | Kubo et al. | 428/219 |
| 5,162,074 A | | 11/1992 | Hills | 156/644 |
| 5,234,327 A | | 8/1993 | Martin | |
| 5,407,621 A | | 4/1995 | Collins et al. | 264/103 |
| 5,484,645 A | | 1/1996 | Lickfield et al. | |
| 5,545,371 A | | 8/1996 | Lu | 264/555 |
| 5,652,051 A | * | 7/1997 | Shawver et al. | 442/362 |
| 5,718,972 A | * | 2/1998 | Murase et al. | 428/360 |
| 5,885,909 A | | 3/1999 | Rudisill et al. | 442/82 |
| 5,939,341 A | * | 8/1999 | Brown et al. | 442/351 |
| 6,038,847 A | * | 3/2000 | Jen | 57/908 |

FOREIGN PATENT DOCUMENTS

| | | |
|---|---|---|
| EP | 0 277 707 A2 | 8/1988 |
| EP | 0 282 660 A1 | 9/1988 |
| EP | 0 753 395 A1 | 1/1997 |

* cited by examiner

*Primary Examiner*—Terrel Morris
*Assistant Examiner*—Alexis Wachtel

(57) ABSTRACT

This invention provides a process for making a nonwoven sheet of substantially continuous melt spun fibers by extruding melt spinnable polymer containing at least 30% by weight low IV poly(ethylene terephthalate), drawing the extruded fiber filaments at a rate of at least 6000 m/min, laying the fiber filaments down on a collection surface, and bonding the fiber filaments together to form a nonwoven sheet. The invention further provides a nonwoven sheet comprised of at least 30% by weight poly(ethylene terephthalate) having an intrinsic viscosity of less than 0.62 dl/g, where the sheet has a basis weight of less than 125 g/m$^2$, and a grab tensile strength of at least 0.7 N/(g/m$^2$).

23 Claims, 2 Drawing Sheets

MELT SPUN POLYESTER NONWOVEN SHEET

BACKGROUND OF THE INVENTION

1. Field of the Invention

This invention relates to nonwoven fibrous structures and more particularly to fabrics and sheet structures formed from fine melt spun polyester fibers held together without weaving or knitting.

2. Description of the Related Art

Nonwoven fibrous structures have existed for many years and today there are a variety of different nonwoven technologies in commercial use. Nonwoven technologies continue to be developed by those seeking new applications and competitive advantages. Nonwoven sheets are commonly made from melt spun thermoplastic polymer fibers.

Melt spun fibers are small diameter fibers formed by extruding molten thermoplastic polymer material as filaments from a plurality of fine, usually circular, capillaries of a spinneret. Melt spun fibers are generally continuous and normally have an average diameter of greater than about 5 microns. Substantially continuous spunbonded fibers have been produced using high speed melt spinning processes, such as the high speed spinning processes disclosed in U.S. Pat. Nos. 3,802,817; 5,545,371; and 5,885,909. In a high speed melt spinning process, one or more extruders supply melted polymer to a spin pack where the polymer is fiberized as it passes through a line of capillary openings to form a curtain of filaments. The filaments are partially cooled in an air quenching zone after they exit the capillaries. The filaments may be pneumatically drawn to reduce their size and impart increased strength to the filaments.

Nonwoven sheets have been made by melt spinning melt spinnable polymers such as polyethylene, polypropylene, and polyester. According to the melt spinning process, the melt spun fibers are conventionally deposited on a moving belt, scrim or other fibrous layer. The deposited fibers are normally bonded to each other to form a sheet of substantially continuous fibers.

Polyester polymers that have been melt spun to make nonwoven sheets include poly(ethylene terephthalate). The intrinsic viscosity of poly(ethylene terephthalate) polyester that has been used in melt spinning such nonwoven sheet structures has been in the range of 0.65 to 0.70 dl/g. The intrinsic viscosity or "IV" of a polymer is an indicator of the polymer's molecular weight, with a higher IV being indicative of a higher molecular weight. Poly(ethylene terephthalate) with an IV below about 0.62 dl/g is considered to be a "low IV" polyester. Low IV polyester has not historically been used in melt spinning nonwoven sheet materials. This is because low IV polyester was considered to be too weak to melt spin filaments that could be efficiently laid down and bonded to produce nonwoven sheets. Fibers melt spun from low IV polyester have been expected to be too weak and discontinuous to withstand the high speed process by which melt spun sheets are produced. In addition, nonwoven sheets melt spun from low IV polyester have been expected to have little strength because the shorter polymer chains of low IV polyester have less interaction with each other that the longer polymer chains in fibers spun from regular IV polyester.

Low intrinsic viscosity poly(ethylene terephthalate) fibers have been extruded and collected via wind up machines on yarn spools. For example, U.S. Pat. No. 5,407,621 discloses a 0.5 denier per filament (dpf) yarn bundle spun from 0.60 dl/g IV poly(ethylene terephthalate) at a spinning speed of 4.1 km/min. U.S. Pat. No. 4,818,456 discloses a 2.2 dpf yarn bundle spun from 0.58 dl/g IV poly(ethylene terephthalate) at a spinning speed of 5.8 km/min. Whereas poly(ethylene terephthalate) fibers and yarns have been made from low IV polyester, strong nonwoven sheets with low denier filaments have not been melt spun from low IV poly(ethylene terephthalate) polyester.

BRIEF SUMMARY OF THE INVENTION

The invention provides a process for making a nonwoven sheet of substantially continuous melt spun fibers, comprising the steps of: extruding melt spinnable polymer containing at least 30% by weight poly(ethylene terephthalate) having an intrinsic viscosity of less than 0.62 dl/g through a plurality of capillary openings in a spin block to form substantially continuous fiber filaments; drawing the extruded fiber filaments by feeding the extruded fiber filaments into a draw jet so as to apply a drawing tension to the fiber filaments, the draw jet including a fiber entrance, a fiber passage where an air jet pulls the filaments in the direction that the filaments are traveling, and a fiber exit through which the drawn filaments are discharged from the draw jet; discharging the drawn fiber filaments as substantially continuous fiber filaments through the fiber exit of the draw jet in a downwardly direction at a rate of at least 6000 m/min; laying the fiber filaments discharged from the fiber exit of the draw jet on a collection surface, the fiber filaments having an average cross sectional area of less than about 90 square microns; and bonding the fiber filaments together to form a nonwoven sheet. The nonwoven sheet has a basis weight of less than 125 g/m2, and a grab tensile strength in both the machine and cross directions, normalized for basis weight and measured according to ASTM D 5034, of at least 0.7 N/(g/m2).

Preferably, at least 75% by weight of the fiber filaments of the nonwoven sheet have as a majority component poly(ethylene terephthalate) with an intrinsic viscosity of less than 0.62 dl/g. The intrinsic viscosity of the poly (ethylene terephthalate) is more preferably in the range of 0.40 to 0.60 dl/g, and most preferably in the range of 0.45 to 0.58 dl/g. The fiber filaments of the nonwoven sheet have an average denier variability as measured by the coefficient of variation of more than 25%. The nonwoven sheet preferably has a boil off shrinkage of less than 5%.

In the process of the invention, the drawn fiber filaments may be discharged through the fiber exit of the draw jet in a downwardly direction at a rate of more than 7000 or 8000 m/min. The fiber entrance of the draw jet is preferably spaced from said capillary openings in said spin block by a distance of at least 30 cm, and the fiber filaments are preferably quenched by a stream of quenching air having a temperature in the range of 5° C. to 25° C. as the fiber filaments pass from the capillary openings in the spin block to the fiber entrance of the draw jet. It is further preferred that the fiber filaments discharged from the fiber exit of the draw jet be guided by an extension plate extending from the draw jet in a direction parallel to the direction that the fibers are discharged from the fiber exit of the draw jet, wherein the fiber filaments pass within 1 cm of the extension plate over a distance of at least 5 cm.

The invention also provides a nonwoven sheet comprised of at least 75% by weight of melt spun substantially continuous fibers (A) that are at least 30% by weight poly (ethylene terephthalate) having an intrinsic viscosity of less than 0.62 dl/g, wherein said fibers have an average cross sectional area of less than about 90 square microns. The nonwoven sheet has a basis weight of less than 125 g/m2, and a grab tensile strength in both the machine and cross directions, normalized for basis weight and measured according to ASTMD 5034, of at least 0.7 N/(g/m2). Preferably, the fibers (A) have as a majority component poly(ethylene terephthalate) having an intrinsic viscosity of less than 0.62 dl/g, and more preferably in the range of 0.40 to 0.60 dl/g, and most preferably in the range of 0.45 to 0.58 dl/g.

The fibers (A) of the nonwoven sheet of the invention may be multiple component fibers wherein one component is primarily poly(ethylene terephthalate). Another component of the fibers (A) may be polyethylene. The nonwoven sheet of the invention can be used in a wiping material. The invention is also directed to composite sheets wherein a layer of the sheet consists of the nonwoven sheet of the invention that is described herein.

BRIEF DESCRIPTION OF THE DRAWING

The invention will be more easily understood by a detailed explanation of the invention including drawings. Accordingly, drawings which are particularly suited for explaining the invention are attached. It should be understood that such drawings are for explanation only and are not necessarily to scale. The drawings are briefly described as follows.

DEFINITIONS

Figure 2:
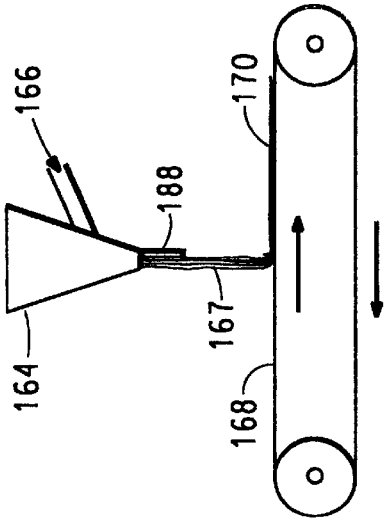
FIG. 2 is a schematic illustration of a portion of an inventive apparatus for making the nonwoven sheet of the invention.

The term "polymer" as used herein, generally includes but is not limited to, homopolymers, copolymers (such as for example, block, graft, random and alternating copolymers), terpolymers, etc. and blends and modifications thereof. Furthermore, unless otherwise specifically limited, the term "polymer" shall include all possible geometrical configurations of the material. These configurations include, but are not limited to isotactic, syndiotactic and random symmetries.

The term "polyethylene" as used herein is intended to encompass not only homopolymers of ethylene, but also copolymers wherein at least 75% of the recurring units are ethylene units.

The term "polyester" as used herein is intended to embrace polymers wherein at least 85% of the recurring units are condensation products of carboxylic acids and dihydroxy alcohols with polymer linkages created by formation of an ester unit. This includes, but is not limited to, aromatic, aliphatic, saturated, and unsaturated acids and di-alcohols. The term "polyester" as used herein also includes copolymers (such as block, graft, random and alternating copolymers), blends, and modifications thereof. A common example of a polyester is poly(ethylene terephthalate) which is a condensation product of ethylene glycol and terephthalate acid.

The term "poly(ethylene terephthalate)" as used herein is intended to embrace polymers and copolymers wherein the majority of the recurring units are condensation products of ethylene glycol and terephthalate acid with polymer linkages created by formation of an ester unit.

The term "melt spun fibers" as used herein means small diameter fibers which are formed by extruding molten thermoplastic polymer material as filaments from a plurality of fine, usually round, capillaries of a spinnerette with the diameter of the extruded filaments then being rapidly reduced. Melt spun fibers are generally continuous and have an average diameter of greater than about 5 microns.

The term "nonwoven fabric, sheet or web" as used herein means a structure of individual fibers or threads that are positioned in a random manner to form a planar material without an identifiable pattern, as in a knitted fabric.

As used herein, the "machine direction" is the long direction within the plane of a sheet, i.e., the direction in which the sheet is produced. The "cross direction" is the direction within the plane of the sheet that is substantially perpendicular to the machine direction.

The term "unitary fibrous sheet" as used herein, means woven or nonwoven fabrics or sheets made of the same types of fibers or fiber blends throughout the structure, wherein the fibers form a substantially homogeneous layer that is free of distinguishable laminations or other support structures.

The term "wiping material" as used herein, means woven or nonwoven fabrics made of one or more layers of fibers which are used to remove particles or liquids from an object.

Test Methods

In the description above and in the non-limiting examples that follow, the following test methods were employed to determine various reported characteristics and properties. ASTM refers to the American Society for Testing and Materials, INDA refers to the Association of the Nonwovens Fabric Industry, IEST refers to the Institute of Environmental Sciences and Technology, and AATCC refers to the American Association of Textile Chemists and Colorists.

Fiber Diameter was measured via optical microscopy and is reported as an average value in microns.

Coefficient of Variation (CV) is a measure of variation in a series of numbers and was calculated as follows:

$$CV = \frac{\text{standard deviation}}{\text{average}} \times 100\%$$

Fiber Size is the weight in grams of 9000 meters of the fiber, and was calculated using the diameter of the fibers measured via optical microscopy and the polymer density, and is reported in deniers.

Fiber Cross Sectional Area was calculated using the diameter of the fibers via optical microscopy based on a round fiber cross section, and is reported in square microns.

Spinning Speed is the maximum speed attained by the fiber filaments during the spinning process. Spinning speed is calculated from polymer throughput per capillary opening expressed in g/min, and the fiber size expressed in g/9000 m (1 denier=1 g/9000 m), according to the following equation:

$$\text{spinning speed (m/min)} = \frac{[\text{polymer throughput per opening (g/min)}](9000)}{[\text{fiber size (g/9000 m)}]}$$

Thickness is the distance between one surface of a sheet and the sheet's opposite surface, and was measured according to ASTM D 5729-95.

Basis Weight is a measure of the mass per unit area of a fabric or sheet and was determined by ASTM D 3776, which is hereby incorporated by reference, and is reported in $g/m^2$.

Grab Tensile Strength is a measure of the breaking strength of a sheet and was conducted according to ASTM D 5034, which is hereby incorporated by reference, and is reported in Newtons.

Elongation of a sheet is a measure of the amount a sheet stretches prior to failure (breaking) in the grab tensile strength test and was conducted according to ASTM D 5034, which is hereby incorporated by reference, and is reported as a percent.

Hydrostatic Head is a measure of the resistance of the sheet to penetration by liquid water under a static pressure. The test was conducted according to AATCC- 127, which is hereby incorporated by reference, and is reported in centimeters. In this application, unsupported hydrostatic head pressures are measured on the various sheet examples in a manner so that if the sheets do not comprise a sufficient number of strong fibers, the measurement is not attainable. Thus, the mere presence of an unsupported hydrostatic head pressure is also an indication that the sheet has the intrinsic strength to support the hydrostatic head pressure.

Frazier Permeability is a measure of air flow passing through a sheet under at a stated pressure differential between the surfaces of the sheet and was conducted according to ASTM D 737, which is hereby incorporated by reference, and is reported in $m^3/min/m^2$.

Water Impact is a measure of the resistance of a sheet to the penetration of water by impact and was conducted according to AATCC 42-1989, which is hereby incorporated by reference, and is reported in grams.

Blood Strike Through is a measure of the resistance of a sheet to the penetration by synthetic blood under a continuously increasing mechanical pressure and was measured according to ASTM F 1819-98.

Alcohol Repellency is a measure of the resistance of a sheet to wetting and penetration by alcohol and alcohol/water solutions, expressed as the highest percentage of isopropyl alcohol solution that the fabric is capable of resisting (expressed on a 10 point scale—10 being pure isopropyl alcohol), and was conducted according to INDA IST 80.6-92.

Spray Rating is a measure of the resistance of a sheet to wetting by water and was conducted according to AATCC 22-1996, and is reported in percent.

Moisture Vapor Transmission Rate is a measure of the rate of diffusion of water vapor through a fabric and was conducted according to ASTM E 96–92, B upright cup, and is reported in $g/m^2/24$ hr.

Trapezoid Tear is a measure of the tearing strength of a fabric in which a tear had previously been started and was conducted according to ASTM D 5733, and is reported in Newtons.

Intrinsic Viscosity (IV) is a measure of the inherent resistance to flow for a polymer solution. IV is determined by comparing the viscosity of a 1% solution of a polymer sample in orthochlorophenol with the viscosity of the pure solvent as measured at 25° C. in a capillary viscometer. IV is reported in dl/g and is calculated using the formula:

$$IV=\eta s/c$$

Where:

$$\eta s = \text{specific viscosity} = \frac{\text{flow time of solution}}{\text{flow time of solvent}} - 1$$

and c is the concentration of the solution in g/100 ml.

GATS is a measurement of a sheet's absorption rate and absorption capacity and is reported as a percent. Testing is done on a Gravimetric Absorbency Testing System (GATS), Model M/K 201, manufactured by M/K Systems, Inc., Danvers, Mass. Tests were conducted on a single 2 inch diameter round test specimen, using a compression of 712 grams, a neutral pressure differential, a single hole test plate, and deionized water. The GATS absorbency rate was reported at 50% of total absorption capacity.

Wicking is a measure of how much time it takes one of a variety of liquids to vertically wick 25 mm up a test strip (25 mm wide by 100 to 150 mm long) of the nonwoven sheet hanging vertically with the bottom 3 mm of test strip immersed in the liquid, and was conducted according to IST 10.1–92.

Fibers is a measure of the number of fibers longer than 100 $\mu$m that are released from a nonwoven sample subjected to mechanical stress in deionized water. A sample is placed in a jar containing 600 ml of deionized water. The jar is placed in a biaxial shaker model RX-86 available from W.S. Tyler, Gastonia, N.C. and shaken for five minutes. The sample is removed from the jar and the liquid contents of the jar are swirled. A 100 ml aliquot of the liquid is filtered using a vacuum funnel through gridded filter membrane, 0.45 $\mu$m, 47 mm, black (Millipore HABG04700) that was prewashed with deionized water. The wall of the funnel is rinsed with deionized water while taking care not to disrupt the contents on the filter membrane. The filter membrane is removed from the vacuum funnel and dried at 170° C. on a hot plate. The filter membrane is placed under a microscope and the number of fibers >100 $\mu$m in length are counted. The number of fibers >100 $\mu$m in length per $cm^2$ of sample is calculated according to the following formula:

$$\text{Fibers}\left(>100\ \mu\text{m/cm}^2\right) = \frac{(F)(V_t)}{(V_s)(A)}$$

Where:

F=total fiber count $V_t$=volume of liquid the sample was shaken in $V_s$=volume of sample liquid tested A=area of sample in square centimeters Particles-Biaxial Shake Test is a measure of the number of particles from a nonwoven sample released in deionized water due to the wetting action of the deionized water and the mechanical agitation of the shaker. The test was performed according to IEST-RP-CC004.2, Section 5.2. Initially a blank is run to determine the background count of particles contributed from the deionized water and the apparatus. 800 ml of clean deionized water is poured into ajar and sealed with aluminum foil. The jar is placed in a biaxial shaker model RX-86 available from W.S. Tyler, Gastonia, N.C. and shaken for one minute. The aluminum foil is removed and 200 ml of liquid is removed for testing. Three portions of the liquid are tested for the number of particles $\geqq 0.5$ $\mu$m in diameter using a particle counter. The results are averaged to determine the blank level of particles. A sample is then placed in the jar with the remaining 600 ml of deionized water. The jar is again sealed with aluminum foil. The jar is shaken for minutes in a biaxial shaker. The aluminum foil is removed and the sample is removed from the jar after allowing the water from the sample to drip into the jar for 10 seconds. Three portions of the liquid are tested for the number of particles ≧0.5 μm in diameter using a particle counter. The results are averaged to determine the sample level of particles. The length and width of the wet sample is measured in centimeters and the area is calculated. The number of particles ≧0.5 μm per $cm^2$ of sample is calculated according to the following formula:

$$\text{Particles } (\geq 0.5\ \mu\text{m})/\text{cm}^2 = \frac{(C-B)(V_t)}{(V_s)(A)}$$

Where:

C=average of sample counts

B=average of blank counts $V_t$=volume of liquid the sample was shaken in $V_s$=volume of sample liquid tested A=area of sample in square centimeters Absorbency is a measure of how much deionized water a nonwoven sample can hold after one minute and is expressed in cubic centimeters of fluid per square meter of sample. A sample cut into a trapezoidal shape 25 mm×88 mm×112 mm with an area of 2500 $mm^2$ is attached to a bifurcated hook fashioned from a paper clip. The sample and hook are weighted. The sample is then immersed in a container of water allowing enough time for the sample to become fully wetted. The sample is then removed from the water and hung vertically for drainage for one minute and then weighed with the hook still attached. The immersion and weighing process is repeated two more times. The absorbency in cc of water per $m^2$ of sample is calculated according to the following formula:

$$\text{Absorbency } (\text{cc/m}^2) = \frac{[(M_1+M_2+M_3)/3]-M_o}{(D)(A)}$$

Where:

$M_o$=mass, in grams, of the sample and hook before wetting $M_1$, $M_2$, $M_3$=masses, in grams, of the sample and hook after wetting and draining D=density of water in grams per cubic centimeter A=area of the test specimen in $mm^2$ Specific Absorbency is a measure of how much deionized water a nonwoven sample can hold after one minute relative to other samples and is expressed in cubic centimeters of water per gram of sample. The specific absorbency in cc of water per gram of sample is calculated according to the following formula:

$$\text{Specific Absorbency } (\text{cc/g}) = \frac{\text{absorbency } (\text{cc/m}^2)}{\text{basis weight of sample } (\text{g/m}^2)}$$

Time to ½ Sorption is a measure of the number of seconds required for the nonwoven sample to reach one half of the saturated capacity or absorbency. A sample is clamped in a modified Millipore Clean Room Monitor Filter Holder (No. XX5004740) using the garment monitoring adapter which segregates an area of $1075\times10^{-6}$ $m^2$ of the sample. Half of the volume of water which the above sample size can hold is calculated according to the following formula:

$$\mu l = \tfrac{1}{2}(\text{absorbency in cc/mm}^2)(1000\ \mu l/\text{cc})(1075\times10^{-6}\ \text{m}^2)$$

The calculated volume of water is delivered to the center of the sample with a microliter syringe. The fluid should be delivered at a rate so that the "specular reflection" never disappears while preventing drops of water from collecting on and falling off of the bottom of the surface. A stopwatch is used to measure the time in seconds before the disappearance of "specular reflection". The test is repeated on two other portions of the sample. The measurements are averaged and the time to ½ sorption is reported in seconds.

Extractables is a measure of the percent extractables of a non-volatile residue of a nonwoven sample in deionized water or 2-propanol (IPA). A sample is cut into 2"×2" pieces and weighed. The sample is placed into a beaker of 200 ml of boiling solvent for 5 minutes. The sample is then transferred to another beaker of 200 ml of boiling solvent for another 5 minutes. The solvent from the first beaker is then filtered through filter paper. The beaker is then rinsed with additional solvent. The solvent from the second beaker is similarly filtered. The filtrates from both beakers are evaporated down to a small volume of approximately 10–20 ml. The remaining solvent is poured into a preweighed aluminum dish. The solvent is completely evaporated in a drying oven or on a hot plate. The dish is cooled to room temperature and weighed. A blank is performed on the filter paper to determine how much contribution the paper has to the extractables test. The weight % extractables in a solvent is calculated according to the following formula:

$$\%\ Extractables = \frac{(A_1-A_2-B)}{S}\times100\%$$

Where:

$A_1$=weight of aluminum dish and residue $A_2$=weight of aluminum dish

B=weight of residue due to blank

S=weight of sample

Metal Ion (sodium, potassium, calcium and magnesium) is measure of the number of metal ions present in the nonwoven sample in ppm. A sample is cut into one-half inch squares and weighed. The sample should weigh between 2 and 5 grams. The sample is placed into a tube. Twenty-five ml of 0.5 M $HNO_3$ is added to the tube. The tube contents are stirred and left to sit for 30 minutes and then stirred again. The solution may be diluted if concentration is later determined to be too high. In preparation of using an atomic absorption spectrophotometer (AAS), appropriate standards are run for the particular ion to be measured. A volume of the sample solution is aspirated into the spectrophotometer and the number of ions of a particular metal is recorded in ppm. After running water through the spectrophotometer, another volume of the sample solution is aspirated into the spectrophotometer. The amount of metal ions as reported in ppm are calculated according to the following formula:

$$\text{Metal Ions (ppm)} = \frac{(\text{average ppm value from AAS})(\text{sample volume in cc})(\text{DF})}{(\text{weight of sample in g})}$$

Where:

DF=dilution factor, if any

DETAILED DESCRIPTION OF THE INVENTION

The present invention is a nonwoven sheet that exhibits high strength and is comprised of low denier fibers melt spun from poly(ethylene terephthalate) fibers of low viscosity. The invention is also directed to a process for making such nonwoven sheets. Such sheet material is useful in end use applications, such a protective apparel fabrics, where the sheet must exhibit good air permeability and good liquid barrier properties. This sheet is also useful as a wiping material, particularly for use in a controlled environment such as a cleanroom where low linting, low particle contamination and good absorbency are required. The nonwoven sheet of the invention may also be useful as a filtration medium or in other end use applications.

The nonwoven sheet of the invention is comprised of at least 75%, by weight, of substantially continuous polymer fibers melt spun from polymer that is at least 30% by weight poly(ethylene terephthalate) having an intrinsic viscosity of less than about 0.62 dl/g. The fibers of the sheet range in size and they have an average cross sectional area of less than about 90 square microns. The sheet has a basis weight of less than 125 g/m$^2$, and a grab tensile strength in both the machine and cross directions of the sheet, normalized for basis weight and measured according to ASTM D 5034, of at least 0.7 N/(g/m$^2$). Preferably, the fibers of the sheet have an average denier variability as measured by the coefficient of variation of more than 25%. More preferably, the nonwoven sheet of the invention is comprised of at least 75% by weight of substantially continuous fibers melt spun from polymer that is at least 50% by weight poly(ethylene terephthalate) having an intrinsic viscosity of less than about 0.62 dl/g.

It has been found that poly(ethylene terephthalate) polymer having an intrinsic viscosity of less than about 0.62 dl/g can be used to make very fine and strong fibers in the nonwoven sheet of the invention. Poly(ethylene terephthalate) with an IV below about 0.62 dl/g is considered to be a low IV polyester, and has not historically been used in melt spinning of nonwoven sheets. Applicants have now found that low IV poly(ethylene terephthalate) can be spun, drawn into fine fibers, laid down and bonded to produce nonwoven sheets with good strength. The use of low IV poly(ethylene terephthalate) has made it possible to melt spin nonwoven sheets of fine polyester fibers of less than 0.8 dpf and to spin the fibers at speeds in excess of 6000 m/min. Surprisingly, it has been found that fibers melt spun of low IV poly(ethylene terephthalate) have good strength equivalent to that of larger poly(ethylene terephthalate) fibers directly spun from regular IV polyester normalized for fiber size.

The fibers in the nonwoven sheet of the invention are small denier polymeric fibers that, when made into a sheet structure, form numerous very small pores. The fibers have a diameter variability in the range of 4 to 12 $\mu$m, which allows the fibers to form denser nonwoven sheets than is possible with similarly sized fibers where all of the fibers are of the same size. Generally, the meltspun fibers of the nonwoven of the invention have a greater diameter variability than fibers spun for yarn applications. The coefficient of variation, a measure of variability, of fiber diameters in melt spun yams generally range from about 5% to about 15%. The coefficient of variation of fiber diameters in nonwovens of the invention is generally greater than about 25%. It has been found that when such melt spun microfibers are used to create a nonwoven fibrous structure, the fabric sheets can be made with fine pores that allow the sheet to exhibit very high air permeability while also providing excellent liquid barrier and sheet strength. As the nonwoven sheet material is comprised of generally continuous filaments, the sheet material also exhibits low linting characteristics desirable for end use applications such as clean room apparel and wipes.

It is believed that the properties of a nonwoven sheet are determined in part by the physical size of the fibers and in part by the distribution of different size fibers in the nonwoven. The preferred fibers in the nonwoven sheet of the invention have a cross sectional area of between about 20 and about 90 $\mu$m$^2$. More preferably, the fibers have a cross sectional area of from about 25 to about 70 $\mu$m$^2$, and most preferably from about 33 to about 60 $\mu$m$^2$. Fiber sizes are conventionally described in terms of denier or decitex. As denier and decitex relate to the weight of a long length of fiber, the density of a polymer can influence the denier or decitex values. For example, if two fibers have the same cross section, but one is made of polyethylene while the other comprises polyester, the polyester fiber would have a greater denier because it tends to be denser than polyethylene. However, it can generally be said that the preferred range of fiber denier is less than or nearly equal to about 1. When used in sheets, compact fiber cross sections, where the fibers exhibit a range of different cross sections, appear to yield sheets with pores that are small but not closed. Fibers with round cross sections and the above cross sectional areas have been used to make the nonwoven sheet of the invention. However, it is anticipated that the nonwoven sheets of the invention might be enhanced by changing the cross sectional shapes of the fibers.

It has been found that a nonwoven sheet of very fine melt spun polyester fibers can be made with sufficient strength to form a barrier fabric without the need for any type of supporting scrim, thus saving the additional materials and cost of such supporting materials. This can be achieved by using fibers with good tensile strength, as for example by using fibers having a minimum tensile strength of at least about 1.5 g/denier. This fiber strength would correspond to a fiber strength of about 182 MPa for a poly(ethylene terephthalate) polyester fiber. Melt blown fibers would typically be expected to have tensile strengths from about 26 to about 42 MPa due to the lack of polymer orientation in the fiber. The grab tensile strength of the composite nonwoven sheet of the invention may vary depending on the bonding conditions employed. Preferably, the tensile strength of the sheet (in both the machine and cross directions), normalized for basis weight, is from 0.7 to 5 N/(g/m$^2$), and more preferably from 0.8 to 4 N/(g/m$^2$), and most preferably from 0.9 to 3 N/(g/m$^2$). Fibers having a tensile strength of at least 1.5 g/denier should provide sheet grab strengths in excess of 0.7 N/(g/m$^2$) normalized for basis weight. The strength of the sheets of the present invention will accommodate most end use applications without reinforcement.

While fiber strength is an important property, fiber stability is also important. It has been found that fine fibers melt spun from low IV poly(ethylene terephthalate) at high speed can be made that exhibit low shrinkage. The preferred sheet of the invention is made with fibers that have an average boil off shrinkage of less than 10%. It has been found that when sheets are produced by the high speed melt spinning process described below with respect to FIG. 1, that sheets of strong fine denier poly(ethylene terephthalate) fibers can be made that have a boil off shrinkage of less than 5%.

According to one embodiment of the invention, the nonwoven sheet may be subjected to a heated nip to bond the fibers of the sheet. The fibers in the bonded sheet appear to be stacked on one another without having lost their basic cross sectional shape. It appears that this is a relevant aspect of the invention because each fiber appears to have not been distorted or substantially flattened which would close the pores. As a result, the sheet can be made with good barrier properties as measured by hydrostatic head while still maintaining a high void ratio, a low density, and high Frazier permeability.

The fibers of the nonwoven sheet of the invention are comprised in substantial part of synthetic melt spinnable poly(ethylene terephthalate) with a low intrinsic viscosity. A preferred fiber is comprised of at least 75% poly(ethylene terephthalate). The fibers may include one or more of any of a variety of polymers or copolymers including polyethylene, polypropylene, polyester, nylon, elastomer, and other melt spinnable polymers that can be spun into fibers of less than approximately 1.1 denier (1.2 decitex) per filament.

The fibers of the nonwoven sheet may be spun with one or more additives blended into the polymer of the fibers. Additives that may be advantageously spun into some or all of the fibers of the nonwoven sheet include fluorocarbons, ultraviolet energy stabilizers, process stabilizers, thermal stabilizers, antioxidants, wetting agents, pigments, antimicrobial agents, and antistatic electricity buildup agents. An antimicrobial additive may be suitable in some healthcare applications. Stabilizers and antioxidants may be provided for a number of end use applications where exposure to ultraviolet energy, such as sunlight, is likely. A static electricity discharge additive may be used for applications where a build up of electricity is possible and undesirable. Another additive that may be suitable is a wetting agent to make the sheet material suitable as a wipe or absorbent or to allow liquids to flow through the fabric while very fine solids are collected in the fine pores of the sheet material. Alternatively, the nonwoven sheet of the invention may be topically treated with a finish in order to alter the properties of the nonwoven sheet. For example, a fluorochemical coating can be applied to the nonwoven sheet to reduce the surface energy of the fiber surfaces and thus increase the fabric's resistance to liquid penetration, especially where the sheet must serve as a barrier to low surface tension liquids. Typical fluorochemical finishes include ZONYL® fluorochemical (available from DuPont, Wilmington, Del.) or REPEARL® fluorochemical (available from Mitsubishi Int. Corp, New York, N.Y.).

In the nonwoven sheet of the invention, the fibers may be comprised of one polymer component that is at least 50% by weight poly(ethylene terephthalate) and at least one other separate polymer component. These polymer components may be arranged in a sheath-core arrangement, a side-by-side arrangement, a segmented pie arrangement, an "islands in the sea" arrangement, or any other known configuration for multiple component fibers. Where the multiple component fibers have a sheath-core arrangement, the polymers may be selected such that the polymer comprising the sheath has a lower melting temperature than the polymer comprising the core, as for example a bicomponent fiber with a core of low IV poly(ethylene terephthalate) and a sheath of polyethylene. Such fibers can be more easily thermally bonded without sacrificing fiber tensile strength. In addition, small denier fibers spun as multiple component fibers may split into even finer fibers after the fibers are spun. One advantage of spinning multi-component fibers is that higher production rates can be attained depending on the mechanism for splitting the multi-component fibers. Each of the resulting split fibers may have a pie-shaped or other-shaped cross section.

Figure 3:
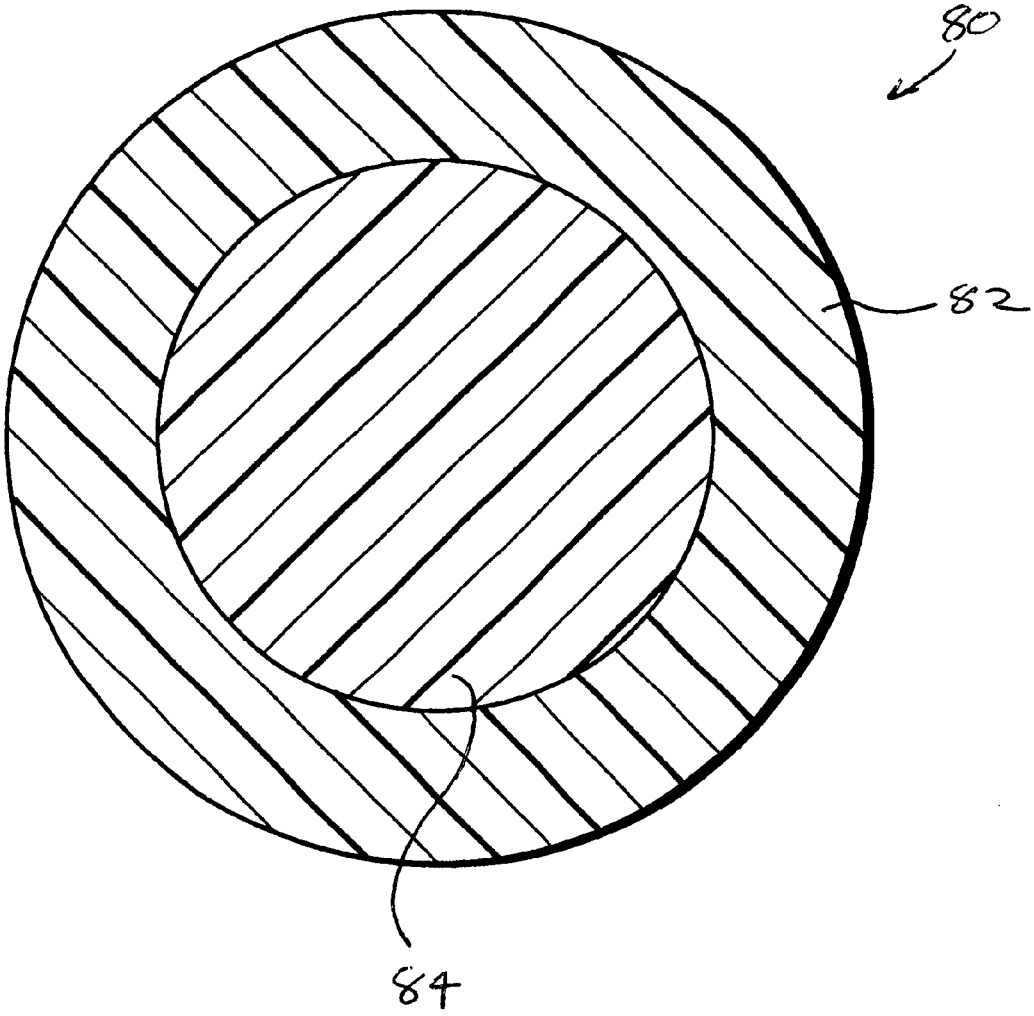
FIG. 3 is an enlarged cross sectional view of a sheath-core bicomponent fiber.

A sheath-core bicomponent fiber is illustrated in FIG. 3 where a fiber 80 is shown in cross section. The sheath polymer 82 surrounds the core polymer 84 and the relative amounts of polymer may be adjusted so that the core polymer 84 may comprise more or less than fifty percent of the total cross sectional area of the fiber. With this arrangement, a number of attractive alternatives can be produced. For example, the sheath polymer 82 can be blended with pigments which are not wasted in the core, thereby reducing the costs for pigments while obtaining a suitably colored material. A hydrophobic material such as a fluorocarbon may also be spun into the sheath polymer to obtain the desired liquid repellency at minimal cost. As mentioned above, a polymer having a lower melt point or melting temperature may be used as the sheath so as to be amenable to melting during bonding while the core polymer does not soften. One interesting example is a sheath core arrangement using low IV poly(ethylene terephthalate) polyester as the core and poly(trimethylene terephthalate) polyester as the sheath. Such an arrangement would be suited for radiation sterilization such as e-beam and gamma ray sterilization without degradation.

Multiple component fibers in the nonwoven of the invention are comprised of at least 30% by weight poly(ethylene terephthalate) having an intrinsic viscosity of less than 0.62 dl/g. In a sheath-core fiber, it is preferred that the core is comprised of at least 50% by weight of low IV poly(ethylene terephthalate) and the core comprises from 40% to 80% by weight of the total fiber. More preferably, the core is comprised of at least 90% by weight of low IV poly(ethylene terephthalate) and the core comprises more than 50% by weight of the total fiber. Other combinations of multi-component fibers and blends of fibers may be envisioned.

The fibers of the nonwoven sheet of the invention are preferably high strength fibers, which conventionally are made as fibers that have been fully drawn and annealed to provide good strength and low shrinkage. The nonwoven sheet of the invention may be created without the steps of annealing and drawing the fibers. Fibers strengthened by high speed melt spinning are preferred for the present invention. The fibers of the nonwoven sheet of the invention may be bonded together by known methods such as thermal calendar bonding, through-air bonding, steam bonding, ultrasonic bonding, and adhesive bonding.

The nonwoven sheet of the invention can be used as a spunbond layer in a composite sheet structure, such as a spunbond-meltblown-spunbond ("SMS") composite sheet. In conventional SMS composites, the exterior layers are spunbond fiber layers that contribute strength to the overall composite, while the core layer is a meltblown fiber layer that provides barrier properties. When the nonwoven sheet of the invention is used for the spunbond layers, in addition to contributing strength, the spunbond fiber layers can provide additional barrier properties to the composite sheet.

The nonwoven sheet of the invention may be produced using a high speed melt spinning process, such as the high speed spinning processes disclosed in U.S. Pat. Nos. 3,802,817; 5,545,371; and 5,885,909; which are hereby incorporated by reference. According to the preferred high speed melt spinning process, one or more extruders supply melted low IV poly(ethylene terephthalate) polymer to a spin pack where the polymer is fiberized as it passes through openings to form a curtain of filaments. The filaments are partially cooled in an air quenching zone while being pneumatically drawn to reduce their size and impart increased strength. The filaments are deposited on a moving belt, scrim or other fibrous layer. Fibers produced by the preferred high speed melt spinning process are substantially continuous and have a diameter of from 5 to 11 microns. These fibers can be produced as single component fibers, as multiple component fibers, or as some combination thereof. Multiple component fibers can be made in various known cross-sectional configurations, including side-by-side, sheath-core, segmented pie, or islands-in-the-sea configurations.

Figure 1:
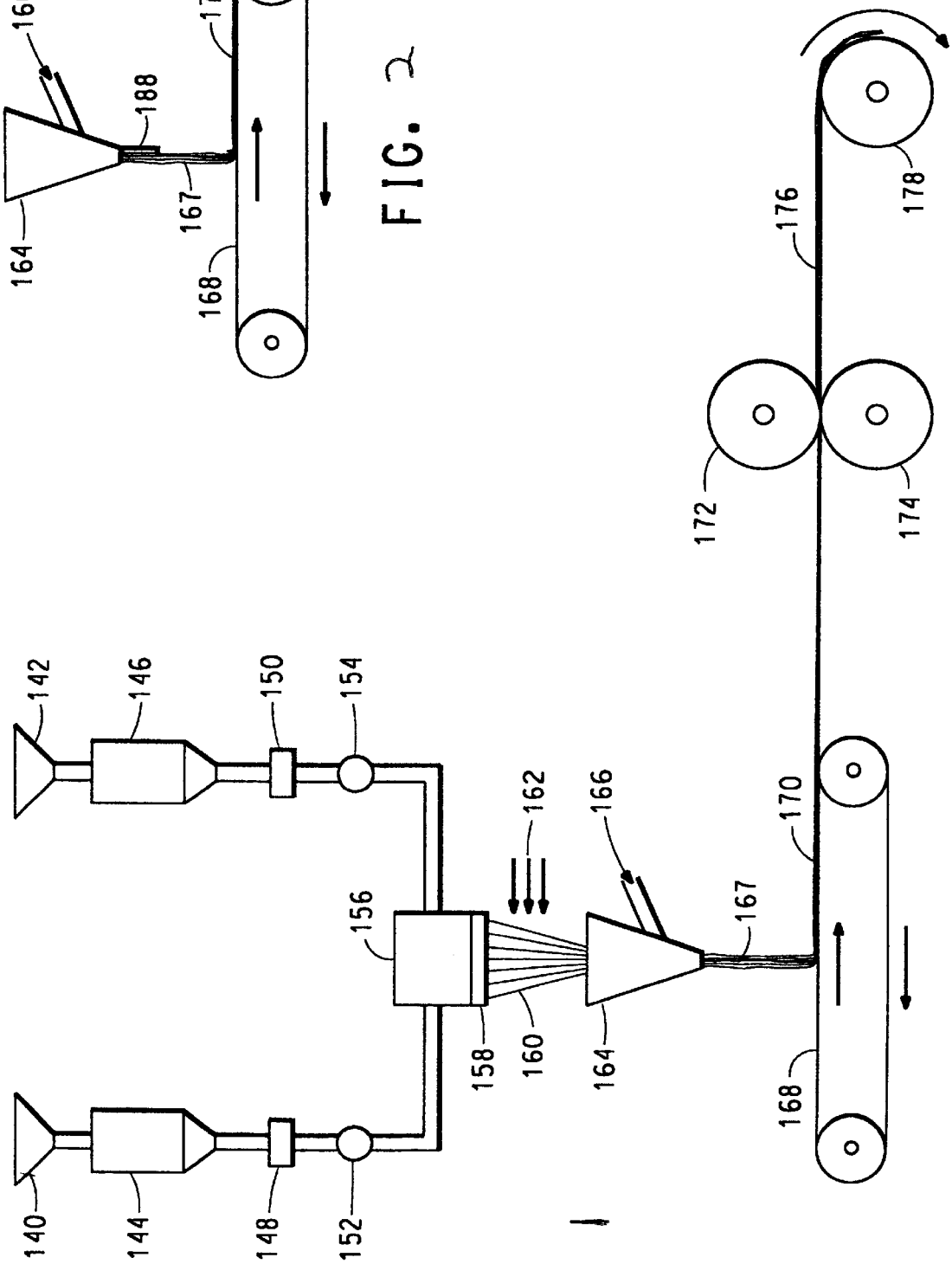
FIG. 1 is a schematic illustration of an apparatus for making the nonwoven sheet of the invention.

An apparatus for producing high strength bicomponent melt spun fibers at high speeds is schematically illustrated in FIG. 1. In this apparatus, two thermoplastic polymers are fed into the hoppers 140 and 142, respectively. The polymer in hopper 140 is fed into the extruder 144 and the polymer in the hopper 142 is fed into the extruder 146. The extruders 144 and 146 each melt and pressurize the polymer and push it through filters 148 and 150 and metering pumps 152 and 154, respectively. The polymer from hopper 140 is combined with polymer from hopper 142 in the spin pack 156 by known methods to produce the desired bicomponent filament cross sections mentioned above, as for example by using a multiple component spin pack like that disclosed in U.S. Pat. No. 5,162,074, which is hereby incorporated by reference. Where the filaments have a sheath-core cross section, a lower melting temperature polymer is typically used for the sheath layer so as to enhance thermal bonding. If desired, single component fibers can be spun from the multiple component apparatus shown in FIG. 1 by putting the same polymer in both of the hoppers 140 and 142.

The melted polymers exit the spin pack 156 through a plurality of capillary openings on the face of the spinneret 158. The capillary openings may be arranged on the spinneret face in a conventional pattern (rectangular, staggered, etc.) with the spacing of the openings set to optimize productivity and fiber quenching. The density of the openings is typically in the range of 500 to 8000 holes/meter width of the pack. Typical polymer throughputs per opening are in the range of 0.3 to 5.0 g/min. The capillary openings may have round cross sections where round fibers are desired.

The filaments 160 extruded from the spin pack 156 are initially cooled with quenching air 162 and then drawn by a pneumatic draw jet 164 before being laid down. The quenching air is provided by one or more conventional quench boxes that direct air against the filaments at a rate of about 0.3 to 2.5 m/sec and at a temperature in the range of 5° to 25° C. Typically, two quench boxes facing each other from opposite sides of the line of filaments are used in what is known as a co-current air configuration. The distance between the capillary openings and the draw jet may be anywhere from 30 to 130 cm, depending on the fiber properties desired. The quenched filaments enter the pneumatic draw jet 164 where the filaments are drawn by air 166 to fiber speeds in the range of from 6000 to 12000 m/min. This pulling of the filaments draws and elongates the filaments as the filaments pass through the quench zone.

Optionally, the end of the pneumatic draw jet 164 may include a draw jet extension 188, as illustrated in FIG. 2. The draw jet extension 188 is preferably a smooth rectangular plate that extends from the draw jet 164 in a direction parallel to the curtain of filaments 167 exiting the draw jet. The draw jet extension 188 guides the filaments to the laydown surface so that the filaments more consistently impinge the laydown surface at the same location which improves sheet uniformity. In the preferred embodiment, the draw jet extension is on the side of the curtain of filaments toward which the filaments move once they are on the laydown belt 168. Preferably, the draw jet extension extends about 5 to 50 cm down from the end of the draw jet, and more preferably about 10 to 25 cm, and most preferably about 17 cm down from the end of the draw jet. Alternatively, the draw jet extension can be placed on the other side of the filament curtain or draw jet extensions can be used on both sides of the curtain of filaments. According to another preferred embodiment of the invention, the draw jet surface facing the filaments could be textured with grooves or rounded protrusions so as to generate a fine scale turbulence that helps to disperse the filaments in a manner that reduces filament clustering and make a more uniform sheet.

The drawn filaments 167 exiting the draw jet 164 are thinner and stronger than the filaments were when they were extruded from the spin pack 156. Even though the fiber filaments 167 are comprised of low IV poly(ethylene terephthalate), the fibers are still substantially continuous filaments having a tensile strength of at least about 1.5 gpd while at the same time having an effective diameter of from 5 to 11 microns. The filaments 167 are deposited onto a laydown belt or forming screen 168 as substantially continuous fiber filaments. The distance between the exit of the draw jet 164 and the laydown belt is varied depending on the properties desired in the nonwoven web, and generally ranges between 13 and 76 cm. A vacuum suction may be applied through the laydown belt 168 to help pin the fiber web on the belt. Where desired, the resulting web 170 can be passed between thermal bonding rolls 172 and 174 before being collected on the roll 178 as bonded web 176. Suitable guides, preferably including air baffles, can be provided to maintain some control as the fibers are randomly arranged on the belt. One additional alternative for controlling the fibers may be to electrostatically charge the fibers and perhaps oppositely charge the belt so that the fibers will be pinned to the belt once they are laid down.

The web of fibers are thereafter bonded together to form the fabric. The bonding may be accomplished by any suitable technique including thermal bonding or adhesive bonding. Hot air bonding and ultrasonic bonding may provide attractive alternatives, but thermal bonding with the illustrated rolls 172 and 174 is preferred. It is also recognized that the sheet material may be point bonded for many applications to provide a fabric-like hand and feel, although there may be other end uses for which it is preferred that the sheet be full surface bonded with a smoother finish. With the point bonded finish, the bonding pattern and percentage of the sheet material bonded will be dictated so as to control fiber liberation and pilling as well as by other requirements such as sheet drape, softness and strength.

Preferably, the bonding rolls 172 and 174 are heated rolls maintained at a temperature within plus or minus 20° C. of the lowest melting temperature polymer in the web and the bonding line speed is in the range of 20 to 100 m/min. In general, a bonding temperature in the range of 105–260° C. and a bonding pressure in the range of 35–70 N/mm have been applied to obtain good thermal bonding. For a nonwoven sheet comprised primarily of low IV poly(ethylene terephthalate) fibers, a bonding temperature in the range of 170–260° C. and a bonding pressure in the range of 35–70 N/mm has been applied to obtain good thermal bonding. If the sheet contains a significant amount of a lower melting temperature polymer, such as polyethylene, a bonding temperature in the range of 105–135° C. and a bonding pressure in the range of 35–70 N/mm may be applied to obtain good thermal bonding.

Where a topical treatment is applied to the web, such as a fluorochemical coating, known methods for applying the treatment can be used. Such application methods include spray application, roll coating, foam application, and dip-squeeze application methods. A topical finishing process can be carried out either in-line with the fabric production or in a separate process step.

This invention will now be illustrated by the following non-limiting examples which are intended to illustrate the invention and not to limit the invention in any manner.

EXAMPLES

In the following examples, nonwoven sheets were produced using a high speed melt spinning process described above with regard to the process shown in FIG. 1.

Example 1

A nonwoven sheet was made from melt spun fibers produced using the process and apparatus described above with regard to FIG. 1. The fibers were spun from poly (ethylene terephthalate) polyester resin with an intrinsic viscosity of 0.58 dl/g available from DuPont as Crystar® polyester (Merge 1988). The polyester resin was crystallized at a temperature of 180° C. and dried at a temperature of 120° C. to a moisture content of less than 50 ppm before use. This polyester was heated to 290° C. in two separate extruders. The polyester polymer was extruded, filtered and metered from each extruder to a bicomponent spin pack maintained at 295° C. and designed to produce a sheath-core filament cross section. However, because both polymer feeds comprised the same polymer, a monocomponent fiber was produced. The spin pack was 0.5 meters wide with a depth of 9 inches (22.9 cm) with 6720 capillaries/meter across the width of the spin pack. Each capillary was round with a diameter of 0.23 to 0.35 mm. The total polymer throughput per spin pack capillary was 0.5 g/min. The filaments were cooled in a 15 inch (38.1 cm) long quenching zone with quenching air provided from two opposing quench boxes at a temperature of 12° C. and a velocity of 1 m/sec. The filaments passed into a pneumatic draw jet spaced 20 inches (50.8 cm) below the capillary openings of the spin pack where the filaments were drawn at a rate of approximately 9000 m/min. The resulting smaller, stronger substantially continuous filaments were deposited onto a laydown belt located 36 cm below the draw jet exit. The laydown belt used vacuum suction to help pin the fibers on the belt. The diameter of 90 filaments was measured to provide an average diameter of 8.6 $\mu$m, a standard deviation of 3.5 $\mu$m and a coefficient of variation of 41%. (Filament diameters in the other examples were calculated from measurements on 10 fibers per sample.)

The web was thermally bonded between an engraved oil-heated metal calender roll and a smooth oil heated metal calender roll. Both rolls had a diameter of 466 mm. The engraved roll had a chrome coated non-hardened steel surface with a diamond pattern having a point size of 0.466 $mm^2$, a point depth of 0.86 mm, a point spacing of 1.2 mm, and a bond area of 14.6%. The smooth roll had a hardened steel surface. The web was bonded at a temperature of 250° C., a nip pressure of 70 N/mm, and a line speed of 50 m/min. The bonded sheet was collected on a roll.

The nonwoven sheet was treated with a fluorochemical finish to reduce the surface energy of the fiber surface, and thus increase the fabric's resistance to liquid penetration. The sheet was dipped into an aqueous bath of 2% (w/w) Zonyl 7040 (obtained from DuPont), 2% (w/w) Freepel 1225 (obtained from B.F. Goodrich), 0.25% (w/w) Zelec TY antistat (obtained from Stepan), 0.18% (w/w) Alkanol 6112 wetting agent (obtained from DuPont). The sheet was then squeezed to remove excess liquid, dried, and cured in an oven at 168° C. for 2 minutes.

The spinning speed and physical properties of the fibers and the sheet are reported in Table 1.

Example 2

A nonwoven sheet was formed according to the procedure of Example 1 except that polymer resin used was film grade poly(ethylene terephthalate) polyester having an intrinsic viscosity of 0.58 dl/g and containing 0.6% by weight calcium carbonate with a typical particle size of less than 100 nanometers in diameter. The spinning speed and physical properties of the fiber and sheet are reported in Table 1.

Comparative Example A

A nonwoven sheet was formed according to the procedure of Example 1 except that the polymer resin used was poly(ethylene terephthalate) polyester with an intrinsic viscosity of 0.67 dl/g available from DuPont as Crystar® polyester (Merge 3934). Also, the sheet bonding temperature was 180° C. instead of 250° C. The spinning speed and physical properties of the fibers and the sheet are reported in Table 1.

The fibers of the nonwoven sheet made in Examples 1 and 2 and in Comparative Example A were melt spun and drawn at high speed to provide very fine fiber size while maintaining overall spinning continuity. The low intrinsic viscosity polyester used in Examples 1 and 2 resulted in fibers with lower denier that were less sensitivity to turbulence in the quench region and than the fibers made with the higher intrinsic viscosity polyester of Comparative Example A. In addition, with the lower intrinsic viscosity polyester of Examples 1 and 2, spinning was more robust (i.e., broken filaments did not cause adjacent filaments to break) than with the higher intrinsic viscosity polymer of Comparative Example A. The low intrinsic viscosity polyester melt spun at high speeds maintained filament strength better than has been the case with low intrinsic viscosity polyester that has been melt spun at conventional speeds. In Examples 1 and 2, the polyester polymer with a low intrinsic viscosity of 0.58 dl/g made smaller size fibers and generally stronger fibers than the polyester polymer of Comparative Example A, which had a higher intrinsic viscosity of 0.67 dl/g.

Example 3

A nonwoven sheet was formed according to the procedure of Example 1 except that 1.5% weight percent cobalt-aluminate based blue pigment was added to the polymer fed into the extruder that fed the sheath portion of the bicomponent spinning apparatus. The polymer from the two extruders fed polymer to the spin pack at relative feed rates so as to make bicomponent fibers that were 50 weight percent sheath and 50 weight percent core. The pigment added to the sheath polymer provided the resulting fabric with color and additional opacity. The spinning speed and physical properties of the fiber and sheet are reported in Table 1.

Example 4

A nonwoven sheet was formed according to the procedure of Example 1 except different polymers were put in the two extruders so as to produce bicomponent sheath-core fibers. A low melt 17% modified di-methyl isophthalate co-polyester with an intrinsic viscosity of 0.61 dl/g produced by DuPont as Crystar® co-polyester (Merge 4442) was used in the sheath and poly(ethylene terephthalate) polyester with an intrinsic viscosity of 0.53 dl/g available from DuPont as Crystar® polyester (Merge 3949) was used in the core. The sheath comprised about 30% of the fiber cross sections and the core comprised about 70% of the fiber cross sections. The sheets were bonded at 150° C. instead of 250° C. The spinning speed and physical properties of the fiber and sheet are reported in Table 1.

Example 5

A nonwoven sheet was formed according to the procedure of Example 4 except that a draw jet extension as described above with regard to FIG. 2 was added. The draw jet extension was a 17 cm long, smooth surface, rectangular plate that extended down from the exit of the draw jet on the side of the curtain of filaments toward which the filaments move once they are on the laydown belt. Also, the sheet was bonded at a temperature of 210° C. instead of 150° C. The spinning speed and physical properties of the fiber and sheet are reported in Table 1.

Example 6

A nonwoven sheet was formed according to the procedure of Example 5 except the draw jet extension was removed.

The spinning speed and physical properties of the fibers and the sheet are reported in Table 1.

Examples 5 and 6 demonstrate that hydrostatic head and tensile properties of a sheet are improved significantly when a draw jet extension is used (Example 5) during spinning of a nonwoven sheet.

TABLE 1

| | Example | | | | | | |
|---|---|---|---|---|---|---|---|
| | 1 | 2 | 3 | 4 | 5 | 6 | A |
| Spinning Speed (m/min) | 6618 | 7714 | 6818 | 7258 | 8333 | 7895 | 4765 |
| Fiber Sheath Polymer | 2GT | 2GT | 2GT | Co-2GT | Co-2GT | Co-2GT | 2GT |
| Fiber Sheath IV (dl/g) | 0.58 | 0.58 | 0.58 | 0.61 | 0.61 | 0.61 | 0.67 |
| Fiber Core Polymer | 2GT | 2GT | 2GT | 2GT | 2GT | 2GT | 2GT |
| Fiber Core IV (dl/g) | 0.58 | 0.58 | 0.58 | 0.53 | 0.53 | 0.53 | 0.67 |
| Fiber Diameter ($\mu$m) | 8.6 | 8.6 | 8.3 | 8.1 | 7.5 | 7.6 | 9.4 |
| Fiber Size (denier) | 0.71 | 0.70 | 0.66 | 0.62 | 0.54 | 0.57 | 0.85 |
| Cross Sectional Area ($\mu m^2$) | 58 | 58 | 54 | 51 | 44 | 45 | 70 |
| Thickness (mm) | 0.36 | 0.30 | 0.36 | 0.34 | 0.33 | 0.31 | 0.30 |
| Basis Weight ($g/m^2$) | 71 | 58 | 71 | 73 | 78 | 78 | 62 |
| Hydrostatic Head (cm) | 39 | 40 | 40 | 38 | 48 | 42 | 20 |
| Blood Strike Through (psig) | 2.0 | | 1.8 | 2.2 | | | 1.2 |
| Water Impact (g) | 0.00 | | 0.06 | 0.05 | 0.08 | 0.09 | 1.50 |
| Alcohol Repellency | 10 | | 10 | 10 | | | 10 |
| Spray Rating (%) | 100 | | 100 | 100 | | | 100 |
| Frazier Air Permeability ($m^3$/min-$m^2$) | 24 | 39 | 21 | 23 | 18 | 24 | 61 |
| Moisture Vapor Transmission Rate ($g/m^2$/24 hr) | 1338 | | 1204 | 1425 | | | 1448 |
| Mullen Burst ($N/m^2$) | 0.22 | | 0.28 | 0.59 | | | 0.24 |
| Grab Tensile MD (N) | 117 | 125 | 126 | 222 | 304 | 259 | 62 |
| Grab Tensile/BW MD (N/g/$m^2$) | 1.6 | 2.2 | 1.8 | 3.1 | 3.9 | 3.3 | 1.0 |
| Elongation MD (%) | 23 | 48 | 21 | 17 | | | 27 |
| Grab Tensile XD (N) | 82 | 82 | 69 | 129 | 228 | 175 | 62 |
| Grab Tensile/BW XD (N/g/$m^2$) | 1.2 | 1.4 | 1.0 | 1.8 | 2.9 | 2.2 | 1.0 |
| Elongation XD (%) | 29 | 72 | 31 | 17 | | | 56 |
| Trapezoid Tear MD (N) | 13 | | 18 | 11 | | | 13 |
| Trapezoid Tear XD (N) | 8 | | 7 | 8 | | | 12 |

IV = intrinsic viscosity
2GT = poly(poly(ethylene terephthalate)
co-2GT = poly(poly(ethylene terephthalate) blended with another polyester

Example 7

A nonwoven sheet was formed according to the procedure of Example 3 except no finish was applied. Absorption and wicking data are reported in Table 2.

Example 8

A nonwoven sheet was formed according to the procedure of Example 7 except it was treated with a surfactant finish to make it wettable by water. The sheet was dipped into an aqueous bath of 0.6% (w/w) Tergitol® 15-S-12 (obtained from Union Carbide). The sheet was then squeezed to remove excess liquid and dried and cured in an oven at 150° C. for 3 minutes. Absorption and wicking data are reported in Table 2.

Example 9

A nonwoven sheet was formed according to the procedure of Example 4 except the bonding temperature was 190° C. instead of 150° C. and no finish was applied. Absorption and wicking data are reported in Table 2.

Example 10

A nonwoven sheet was formed according to the procedure of Example 9 except it was treated with a surfactant finish to make it wettable by water. The sheet was dipped into an aqueous bath of 0.6% (w/w) Tergitol® 15-S-12 (obtained from Union Carbide). The sheet was then squeezed to remove excess liquid and dried and cured in an oven at 150° C. for 3 minutes. Absorption and wicking data are reported in Table 2.

TABLE 2

NONWOVEN SHEET ABSORPTION AND WICKING PROPERTIES

| | Example | | | |
|---|---|---|---|---|
| | 7 | 8 | 9 | 10 |
| GATS Capacity for Water (%) | 0 | 416 | 0 | 493 |
| GATS Rate for Water (g/g/s at 50% Capacity) | 0 | 0.39 | 0 | 0.52 |
| Wicking for Water (s to 1 inch) | wnw | 8.8 | wnw | 7.1 |
| Wicking for Cooking Oil (s to 1 inch) | 317 | 365 | 396 | 336 |
| Wicking for 10W-30 Motor Oil (s to 1 inch) | 1375 | 1859 | 1637 | 1671 |
| Wicking for Hexane (s to 1 inch) | 4.1 | 6.9 | 4.1 | 5.7 |

wnw = would not wick

Example 11

A nonwoven sheet was formed according to the procedure of Example 1 except for the following changes. No fluorochemical finish was applied. The bonding line speed was 28 m/min resulting in a basis weight of 122 $g/m^2$. The sheet was subjected to a cleanroom laundering process. This process included agitating the sheet in hot water (minimum 120° F. (49° C.)) with a non-ionic surfactant (about 1.8 gallons water/pound of sheet material (15 liters/kilogram)). The hot water had been purified by a reverse osmosis treatment and had a conductivity of 4 to 6 micromhos/cm. The sheet was subsequently rinsed in deionized water (about 1.2 gallons water/pound of sheet material (10 liters/kilogram)). The deionized water had a resistance of about 18 megohms/cm. Both types of water were filtered to 0.2 microns. Sheet property data, including data relevant to performance as a wipe material, is reported in Table 3.

Example 12

A nonwoven sheet was formed according to the procedure of Example 4 except for the following changes. No fluorochemical finish was applied. The bonding line speed was 28 m/min resulting in a basis weight of 129 g/m$^2$. The sheet was subjected to a cleanroom laundering process. This process included agitating the sheet in hot water (minimum 120° F. (49° C.)) with a non-ionic surfactant (about 1.8 gallons water/pound of sheet material (15 liters/kilogram)). The hot water had been purified by a reverse osmosis treatment and had a conductivity of 4 to 6 micromhos/cm. The sheet was subsequently rinsed in deionized water (about 1.2 gallons water/pound of sheet material (10 liters/kilogram)). The deionized water had a resistance of about 18 megohms/cm. Both types of water were filtered to 0.2 microns. Sheet property data, including data relevant to performance as a wipe material, is reported in Table 3.

TABLE 3

NONWOVEN SHEET WIPE PROPERTIES

| | Example | |
|---|---|---|
| | 11 | 12 |
| Fibers (>100 $\mu$m/cm$^2$) | 0.37 | 0.16 |
| Particles (× 10$^3$/cm$^2$) | 2.4 | 1.6 |
| Absorbency (cc/m$^2$) | 394 | 614 |
| Specific Absorbency (cc/g) | 3.0 | 4.2 |
| Time to ½ Sorption (s) | 1 | 2 |
| Extractables (% w/water) | 0.03 | 0.03 |
| Extractables (% w/IPA) | 0.27 | 0.51 |
| Sodium (ppm) | 1.3 | 1.2 |
| Potassium (ppm) | 0.15 | 0.07 |
| Calcium (ppm) | 1.2 | 1.1 |
| Magnesium (ppm) | 0.04 | 0.03 |

The foregoing description and drawings were intended to explain and describe the invention so as to contribute to the public base of knowledge. In exchange for this contribution of knowledge and understanding, exclusive rights are sought and should be respected. The scope of such exclusive rights should not be limited or narrowed in any way by the particular details and preferred arrangements that may have been shown. The scope of any patent rights granted on this application should be measured and determined by the claims that follow.

We claim:

1. A process for making a nonwoven sheet of substantially continuous multiple component melt spun fibers, comprising the steps of:

extruding melt spinnable polymer containing at least 30% by weight of a first component of poly(ethylene terephthalate) having an intrinsic viscosity of less than 0.62 dl/g and a second melt spinnable polymer component through a plurality of capillary openings in a spin block to form substantially continuous multiple component fiber filaments;

drawing said extruded multiple component fiber filaments by feeding the extruded multiple component fiber filaments into a draw jet so as to apply a drawing tension to the multiple component fiber filaments, said draw jet including a fiber entrance, a fiber passage where an air jet pulls the filaments in the direction that the filaments are traveling, and a fiber exit through which the drawn filaments are discharged from the draw jet;

discharging the drawn multiple component fiber filaments as substantially continuous multiple component fiber filaments through the fiber exit of the draw jet in a downwardly direction at a rate of at least 6000 m/min;

laying the multiple component fiber filaments discharged from the fiber exit of the draw jet on a collection surface, said multiple component fiber filaments having an average cross sectional area of less than about 90 square microns; and bonding the multiple component fiber filaments together to form a nonwoven sheet, wherein said nonwoven sheet has a basis weight of less than 125 g/m$^2$, said nonwoven sheet has a machine direction and a cross direction, and said nonwoven sheet has a grab tensile strength in both the machine and cross directions, normalized for basis weight and measured according to ASTM D 5034, of at least 0.7 N/(g/m$^2$).

2. The process of claim 1 wherein at least 75% by weight of the fiber filaments of said nonwoven sheet have as a majority component said poly(ethylene terephthalate) with an intrinsic viscosity of less than 0.62 dl/g.

3. The process according to claim 2 wherein the intrinsic viscosity of said poly(ethylene terephthalate) is in the range of 0.40 to 0.60 dl/g.

4. The process according to claim 3 wherein the intrinsic viscosity of said poly(ethylene terephthalate) is in the range of 0.45 to 0.58 dl/g.

5. The process according to claim 1, wherein the fiber filaments of said nonwoven sheet have an average denier variability as measured by the coefficient of variation of more than 25%.

6. The process according to claim 2, wherein the sheet has a boil off shrinkage of less than 5%.

7. The process according to claim 2 wherein said 75% by weight of the fiber filaments of said nonwoven sheet having a majority component of poly(ethylene terephthalate) with an intrinsic viscosity of less than 0.62 dl/g fibers have a boil off shrinkage of less than 5%.

8. The process according to claim 1 wherein the drawn fiber filaments are discharged through the fiber exit of the draw jet in a downwardly direction at a rate of at least 7000 m/min.

9. The process according to claim 1 wherein the drawn fiber filaments are discharged through the fiber exit of the draw jet in a downwardly direction at a rate of at least 8000 m/min.

10. The process of claim 1 wherein said fiber entrance of said draw jet is spaced from said capillary openings in said spin block by a distance of at least 30 cm.

11. The process of claim 10 wherein the fiber filaments are quenched by a stream of quenching air having a temperature in the range of 5° C. to 25° C. as the fiber filaments pass from the capillary openings in said spin block to the fiber entrance of the draw jet.

12. The process of claim 1 wherein the fiber filaments discharged from the fiber exit of the draw jet are guided by an extension plate extending from the draw jet in a direction parallel to the direction that the fibers are discharged from the fiber exit of the draw jet, said fiber filaments passing within 1 cm of said extension plate over a distance of at least 5 cm.

13. A nonwoven sheet comprised of at least 75% by weight of melt spun substantially continuous multiple component fibers (A) that are at least 30% by weight poly (ethylene terephthalate) having an intrinsic viscosity of less than 0.62 dl/g, wherein said fibers have an average cross sectional area of less than about 90 square microns, and said nonwoven sheet has a basis weight of less than 125 $g/m^2$, said nonwoven sheet has a machine direction and a cross direction, and said nonwoven sheet has a grab tensile strength in both the machine and cross directions, normalized for basis weight and measured according to ASTM D 5034, of at least 0.7 $N/(g/m^2)$.

14. The nonwoven sheet of claim 13 wherein said fibers (A) having as a majority component poly(ethylene terephthalate) having an intrinsic viscosity of less than 0.62 dl/g.

15. The sheet according to claim 14 wherein the intrinsic viscosity of said poly(ethylene terephthalate) is in the range of 0.40 to 0.60 dl/g.

16. The sheet according to claim 15 wherein the intrinsic viscosity of said poly(ethylene terephthalate) is in the range of 0.45 to 0.58 dl/g.

17. The sheet according to claim 13, wherein said fibers (A) have an average denier variability as measured by the coefficient of variation of more than 25%.

18. The sheet according to claim 13, wherein the sheet has a boil off shrinkage of less than 5%.

19. The sheet according to claim 13, wherein said fibers (A) have a boil off shrinkage of less than 5%.

20. The sheet of claim 13 wherein one component of said fibers (A) is polyethylene.

21. A wiping material made of the nonwoven sheet of claim 13.

22. A composite sheet comprised of a first sheet layer consisting of the nonwoven sheet of claim 13 and a second sheet layer consisting primarily of fibers meltblown from a synthetic polymer, said second sheet layer having first and second opposite side, wherein the first side of said second sheet layer is bonded to said first sheet layer.

23. The composite sheet 22 further comprising a third sheet layer comprised of the nonwoven sheet of claim 13, wherein said second side of said second sheet layer is bonded to said third sheet layer.

* * * * *